US012728956B1

(12) United States Patent
Esham

(10) Patent No.: US 12,728,956 B1
(45) Date of Patent: Sep. 8, 2026

(54) WINDSHIELDS FOR MARINE VESSELS

(71) Applicant: Brunswick Corporation, Mettawa, IL (US)

(72) Inventor: Noah S. Esham, Edgewater, FL (US)

(73) Assignee: Brunswick Corporation, Mettawa, IL (US)

( * ) Notice: Subject to any disclaimer, the term of this patent is extended or adjusted under 35 U.S.C. 154(b) by 269 days.

(21) Appl. No.: 18/638,315

(22) Filed: Apr. 17, 2024

(51) Int. Cl.
*B63B 19/02* (2006.01)
*B63B 19/00* (2006.01)

(52) U.S. Cl.
CPC ..... *B63B 19/02* (2013.01); *B63B 2019/0069* (2013.01)

(58) Field of Classification Search
CPC . B63B 19/00; B63B 19/02; B63B 2019/0007; B63B 2019/0038; B63B 2019/0053; B63B 2019/0069
USPC ..... 114/343, 361
See application file for complete search history.

(56) References Cited

U.S. PATENT DOCUMENTS 2,836,140 A 5/1958 Hunt, Jr.
3,161,895 A 12/1964 Lewis
3,906,563 A 9/1975 Bramhall
5,505,156 A * 4/1996 Briggs ..... B63B 19/02 114/361
7,144,061 B1 12/2006 Behm
7,178,476 B1 2/2007 Belkov
7,213,533 B2 * 5/2007 Gonzales ..... B63B 17/02 114/361
7,255,057 B2 8/2007 Wright
7,421,969 B2 * 9/2008 Mercier ..... B63B 19/00 114/361
7,845,304 B2 * 12/2010 Daniels ..... B63B 17/02 114/361
9,233,734 B2 1/2016 Erskine
9,688,363 B1 6/2017 Marshall
10,167,058 B2 1/2019 Shearer
10,246,164 B1 * 4/2019 Flota ..... E05F 15/56
10,800,494 B2 10/2020 Deal
11,345,446 B2 * 5/2022 Wilson ..... B63B 19/02
12,128,990 B1 * 10/2024 Berman ..... B63B 17/02
2018/0072386 A1 3/2018 Dubé

OTHER PUBLICATIONS

Declaration of prior art by inventor, dated May 21, 2024.
(Continued)

*Primary Examiner* — Daniel V Venne
(74) *Attorney, Agent, or Firm* — Andrus Intellectual Property Law, LLP

(57) ABSTRACT

A marine vessel includes a bow and a stern, a deck, a console located on the deck between the bow and the stern, and a windshield on the console. The windshield includes a side panel and a movable panel coupled to the side panel. The movable panel includes a first panel surface and the movable panel is pivotable about a first pivot axis and a second pivot axis into and between a first position in which the movable panel extends adjacent to the side panel and the first panel surface is oriented toward the bow and a second position in which the movable panel overlaps the side panel and the first panel surface is oriented toward the bow.

20 Claims, 11 Drawing Sheets

(56) References Cited

OTHER PUBLICATIONS

Deluca et al. "Marine Vessels and Convertible Windshield Apparatuses for Marine Vessels" Unpublished U.S. Appl. No. 17/743,144, filed May 12, 2022.
"Gas Springs" accessed from https://www.bansbach.com/en/cad-configurator/gas-springs/ on Oct. 28, 2024.
"Freedom 325" accesed from https://www.gradywhite.com/models/dual-consoles/freedom-325/ on Oct. 29, 2024.
"LA12" accessed from https://www.linak-us.com/products/linear-actuators/la12/#/description on Oct. 29, 2024.

* cited by examiner

PORT SIDE ← → STARBOARD SIDE
T

WINDSHIELDS FOR MARINE VESSELS

FIELD

The present disclosure relates to windshields for marine vessels, and specifically to windshields with a movable panel.

BACKGROUND

The following U.S. Patent is incorporated herein by reference in entirety.

U.S. Pat. No. 7,144,061 discloses a retractable windshield and collapsible console apparatus which can be raised and the windshield extended when needed to afford additional protection to persons from conditions due to environment, and to allow for convenient and safe stowing of the apparatus in the same location without causing an obstruction. The console can be collapsed and stowed into a position which is substantially parallel relative to a base on the floor or other surface of a boat, other vehicle or other structure when not in use.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain independent examples, a marine vessel includes a bow and a stem, a deck, a console located on the deck between the bow and the stem, and a windshield on the console. The windshield includes a side panel and a movable panel coupled to the side panel. The movable panel includes a first panel surface and the movable panel is pivotable about a first pivot axis and a second pivot axis into and between a first position in which the movable panel extends adjacent to the side panel and the first panel surface is oriented toward the bow and a second position in which the movable panel overlaps the side panel and the first panel surface is oriented toward the bow.

Optionally, the deck defines a pathway thereon, and in the first position, the movable panel closes the pathway and in the second position the pathway is open. Optionally, the first pivot axis and the second pivot axis are parallel to each other. Optionally, the first pivot axis and the second pivot axis extend transverse to the movable panel. Optionally, a first support arm and a second support arm spaced apart from the first support arm couple the movable panel to the side panel and a first guide arm and a second guide arm spaced apart from the second guide arm couple the movable panel to the side panel. Optionally, a rest pad is coupled to the console and configured to axially cam the movable panel in a first axial direction as the movable panel is moved into the second position. Optionally, a guide block is coupled to the side panel and a rest block coupled to the movable panel such that when the movable panel is moved into the first position, the rest block engages the guide block such that the guide block cams the movable panel in a first axial direction.

In certain independent examples, a marine vessel includes a bow and a stem, a deck, a pair of consoles located on the deck between the bow and the stem, and a windshield on the consoles. The windshield includes a first side panel, a second side panel, and a movable panel coupled to the first side panel. The movable panel includes a first panel surface and is pivotable about a first pivot axis and a second pivot axis into and between a first position in which the movable panel extends between the first side panel and the second side panel and the first panel surface is oriented toward the bow and a second position in which the movable panel overlaps the first side panel and the first panel surface is oriented toward the bow.

Optionally, a pathway extends between the consoles and in the first position the movable panel closes the pathway and in the second position the pathway is open. Optionally, the first pivot axis and the second pivot axis are parallel to each other. Optionally, the first pivot axis and the second pivot axis extend transverse to the movable panel. Optionally, a rest pad coupled is to one console of the pair of consoles and configured to axially cam the movable panel in a first axial direction as the movable panel is moved into the second position. Optionally, a guide block is coupled to the first side panel and a rest block coupled to the movable panel, and when the movable panel is moved toward the first position, the rest block engages the guide block such that the guide block cams the rest block and the movable panel in a first axial direction.

In certain independent examples, a marine vessel includes a bow and a stem, a deck, a console on the deck between the bow and the stern, and a windshield on the console. The windshield includes a side panel and a movable panel pivotably coupled to the side panel such that the movable panel is pivotable about a first pivot axis and a second pivot axis into and between a first position in which the movable panel extends adjacent the side panel and a second position in which the movable panel overlaps the side panel.

Optionally, the first pivot axis and the second pivot axis are spaced apart from and parallel to each other. Optionally, the bow is longitudinally spaced apart from the stern and the first pivot axis and the second pivot axis are longitudinally offset from the movable panel in a direction toward the stem. Optionally, the deck defines a pathway thereon, and in the first position, the movable panel closes the pathway and in the second position the pathway is open. Optionally, a hinge assembly couples the side panel to the movable panel, and the hinge assembly includes a support arm with a first support arm end through which the first pivot axis extends and a second support arm end through which the second pivot axis extends and a guide arm with a first guide arm end through which a third pivot axis extends and a second guide arm end through which a fourth pivot axis extends. The movable panel is further pivotable of the third pivot axis and the fourth pivot axis into and between the first position and the second position. Optionally, the hinge assembly includes a flange coupled to the side panel and a bracket coupled to the movable panel. The first support arm end and the first guide arm end are coupled to the flange and the second support arm end and the second guide arm end are coupled to the bracket. Optionally, the first pivot axis, the second pivot axis, the third pivot axis, and the fourth pivot axis are parallel to each other and extend transverse to the movable panel.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

The present inventor, through research and experimentation in the field of marine vessels, recognized that some marine vessels (e.g., hard top boats, dual console boats, pontoon boats, yachts, fishing boats, and the like) include one or more conventional windows that act as a windshield for operators of the boat. These conventional windows and/or windshields often extend across the marine vessel between the port side and the starboard side to block wind and other environmental conditions such as rain and/or water spray.

The present inventor observed that conventional windshields often have several disadvantages. For example, in some conventional dual console-open bow boats with a center pathway between the dual consoles, a wind tunnel effect down the longitudinal centerline can occur which may be unpleasant to the occupants of the marine vessel, especially during adverse weather conditions. In addition, some conventional windshields may not adequately block wind and other environmental conditions, and/or do not adequately block rain or water spray.

Some conventional windshields attempt to solve the problems by including a moveable panel that can be moved to selectively at least partially open or close the pathway. In these examples, the movable panel pivots 180.0 degrees or more along a single axis onto the side panel. However, these conventional windshields may not provide adequate protection for the occupants and the pivoting movement of the moveable panel may be obstructed by a hardtop positioned above the windshield. Other conventional windshields may permit the movable panel to be pivoted downwardly and rearwardly toward the stem; however, such pivoting motion can disadvantageously obstruct the pathway and/or create a hazard for the occupants (e.g., sharp heavy corners of the movable panel).

Some other example conventional windshields attempt to solve the problems by providing two smaller movable panels hinged to the side panel. However, these example conventional windshields disadvantageously require a multi-step process to operate, may require additional sealing considerations between the movable panels and/or the side panels, present head obstructions or hazards, and/or may be heavy and thereby prevent smooth operation thereof. In still other examples, some conventional windshields attempt to solve the problems by providing a laterally extending slide track in front of the stationary panels for the center movable window to be moved along; however, the slide track and associated hardware may be complex and/or intrude upon space on the marine vessel that would otherwise be utilized by the occupants thereon.

The present inventor recognized that it would be advantageous to develop windshields that are new, solve problems with conventional windshields, and/or have improvements over conventional windshields. Accordingly, the present inventor developed the example windshields of the present disclosure described herein below.

Figure 1:
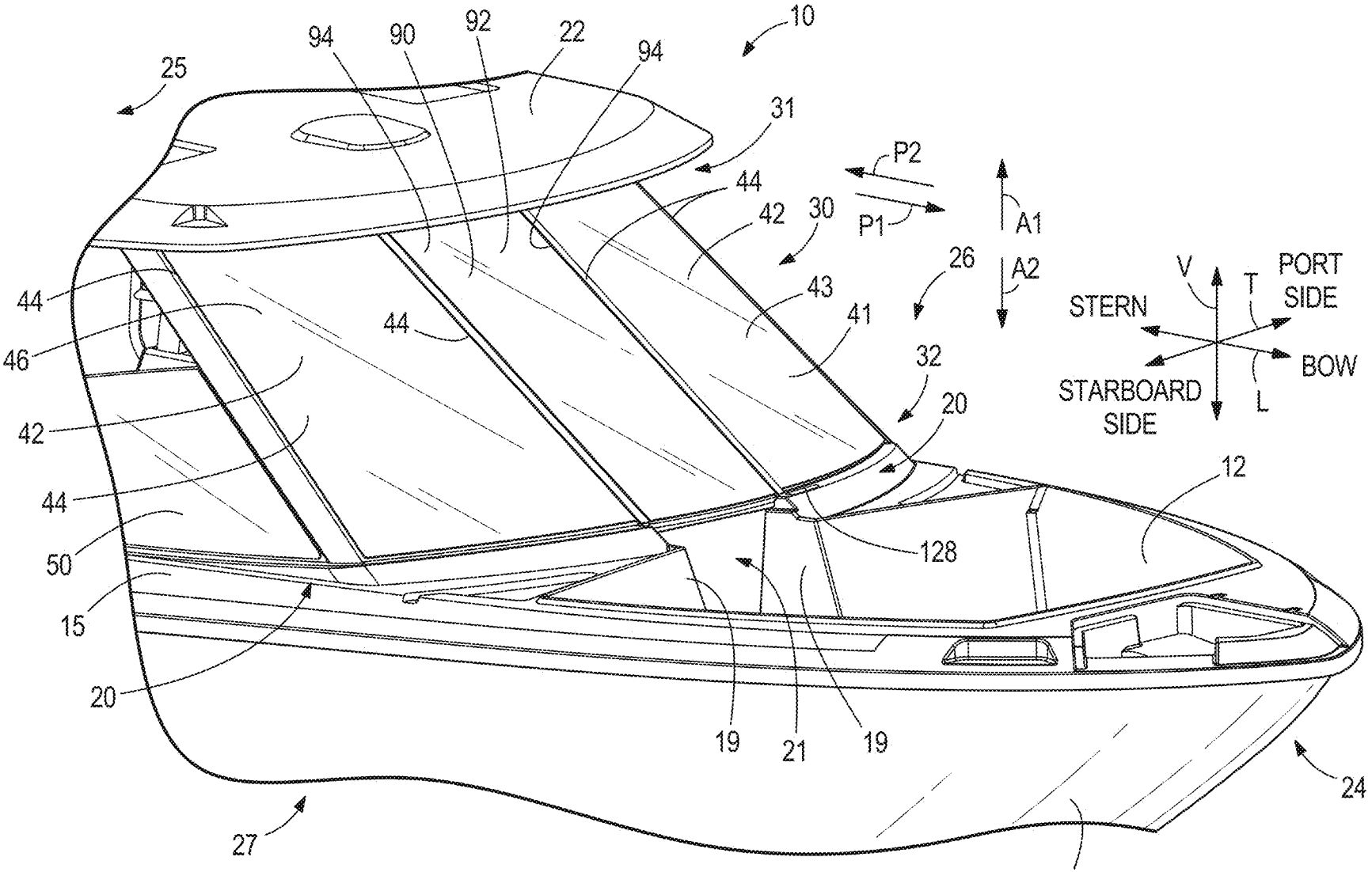
FIG. 1 is a perspective view of an example marine vessel and example windshield according to the present disclosure. An example moveable panel of the windshield is in a first position.
Figure 2:
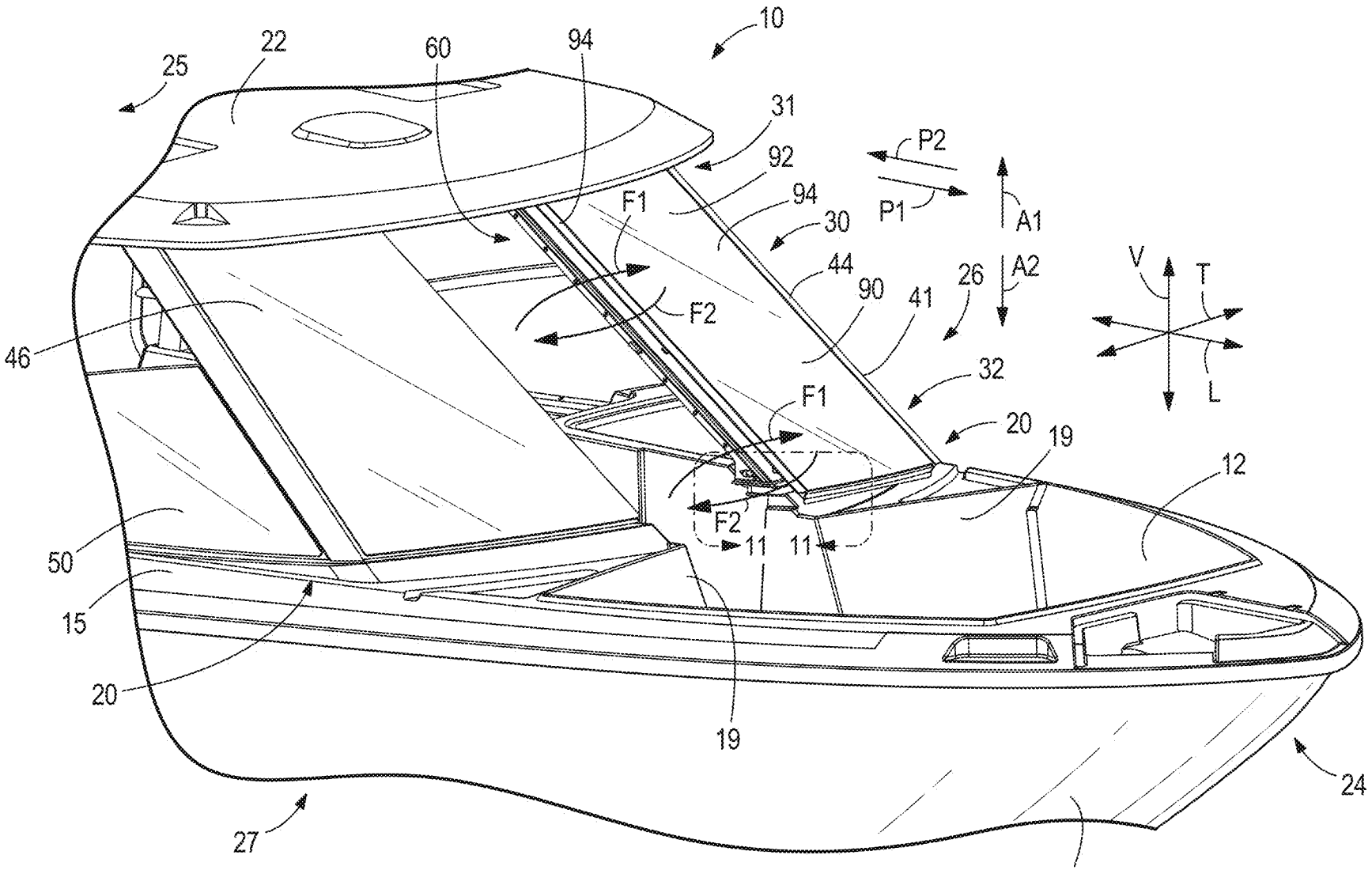
FIG. 2 is a perspective view of the windshield of FIG. 1 with the movable panel in a second position.

FIGS. 1-2 depict a partial view of an example marine vessel 10 according to the present disclosure. The marine vessel 10 longitudinally extends between a bow 24 and a stern 25 (see example longitudinal axis L) and laterally extends between a port side 26 and a starboard side 27 (see example lateral axis T which is perpendicular to the longitudinal axis L). Note that the lateral axis T and the longitudinal axis L are each also perpendicular to an example axis V, which in certain examples is a vertical axis. The marine vessel 10 is propelled through a body of water by one or more marine propulsion devices (not depicted).

The marine vessel 10 includes a hull 14 and a deck 12 with a deck surface (not depicted) on which components of the marine vessel 10 can be placed and the occupants walk or stand. A sidewall 15 extends around the marine vessel 10. The deck 12 includes or supports one or more panels or sidewalls 19 that at least partially form a pair of consoles 20 of the marine vessel 10. The sidewalls 19 and the consoles 20 axially extend above the deck surface and are located between the port side 26 and the starboard side 27. A pathway 21 extends along the deck surface 16, through the windshield 30, and/or between the consoles 20. Occupants may pass through the pathway 21 to move past the consoles 20 toward the bow 24 or the stern 25.

The console(s) 20 provides the helm at which an operator can control operation of the marine vessel 10. An example windshield 30 according to the present disclosure wraps around the consoles 20 on top of the sidewalls 19 opening toward the stem 25 of the marine vessel 10. The windshield 30 advantageously shields occupants at the helm from wind and other environmental conditions. A hardtop 22 is located above the windshield 30.

The windshield 30 generally extends between a first end 31 located at the hardtop 22 and an opposite second body end 32 located on the consoles 20. The windshield 30 includes one or more stationary side panels, namely a first side panel 41 and a second side panel 46, which are fixed in place on the consoles 20 and located on opposing sides of a movable panel 90 (described further herein). The windshield 30 also includes one or more auxiliary panels 50 adjacent to the side panels 41, 46.

As will be described in greater detail herein below, the movable panel 90 is movable into and between a first position in which the movable panel 90 extends from the first side panel 41 and/or extends between the side panels 41, 46 thereby preventing or reducing wind and other environmental elements from passing through the pathway 21 and a second position in which the movable panel 90 overlaps and/or is located in a stacked configuration above or one side panels 41, 46 thereby permitting passage through the pathway 21.

Figure 3:
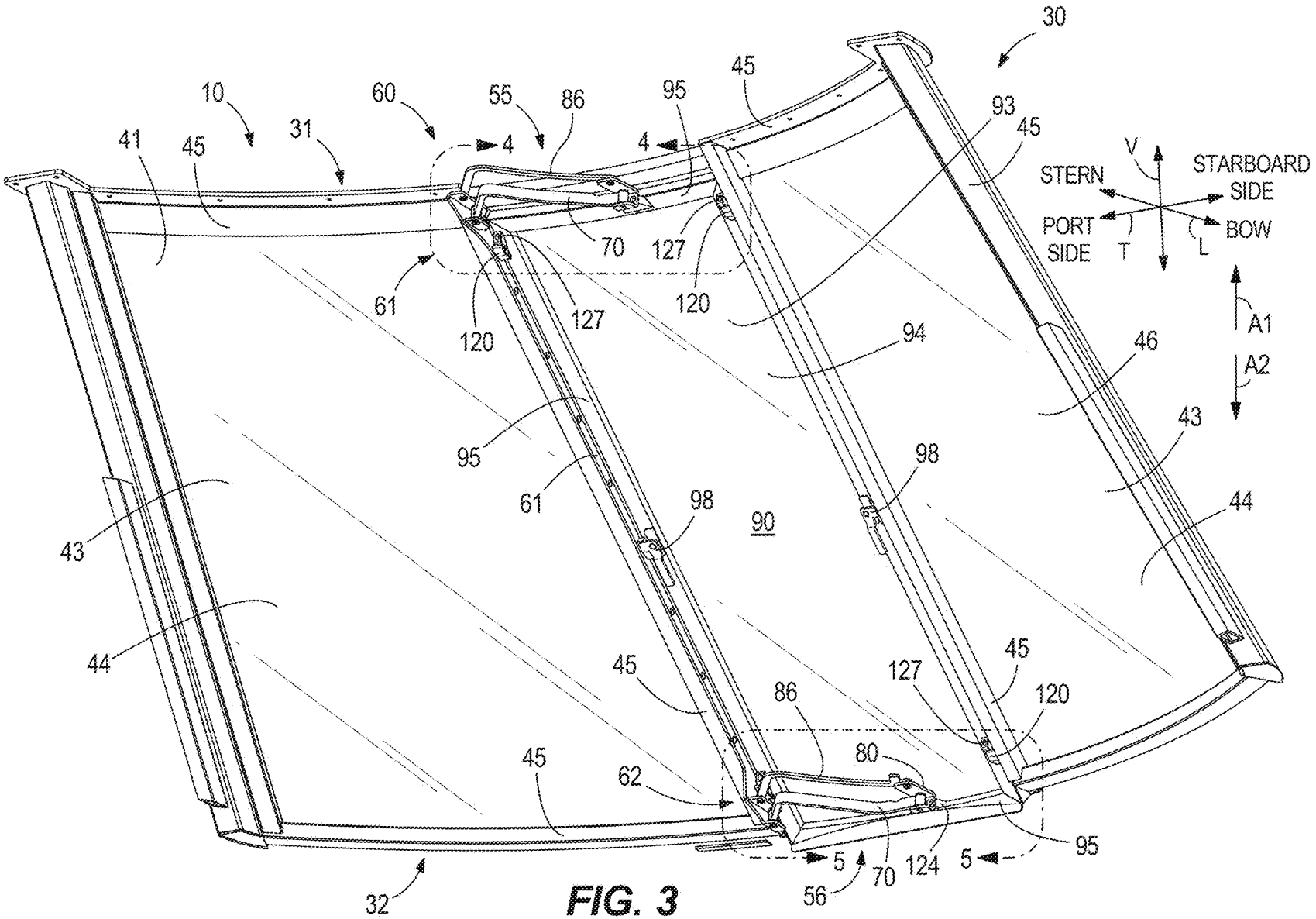
FIG. 3 is a perspective view of the windshield of FIG. 1 with the movable panel in the first position.

Turning now to FIG. 3, the movable panel 90 is coupled to the first side panel 41 with a hinge assembly 60. Note while the example windshields 30 described herein include the movable panel 90 coupled to the first side panel 41 it should be understood that in other examples the movable panel 90 is alternatively coupled to the second side panel 46. In these other examples, the features and/or components described herein with respect to and/or associated with the movable panel 90 and the first side panel 41 may be included, reversed, inverted, and/or mirrored when the movable panel 90 coupled to the second side panel 46. Further note that the second side panel 42 can include features and/or components similar to the features and/or components of the first side panel 41.

The first side panel 41 has a first panel surface 42 that is oriented in a first panel direction P1 and/or toward the bow 24 and an opposite second panel surface 43 that is oriented in a second panel direction P2 and/or toward the stern 25. Note that the first side panel 41 is angled relative to the consoles 20 (e.g., the first side panel 41 and the top of the consoles 20 define an acute angle therebetween) such that the second panel surface 43 is also oriented toward or faces the consoles 20 and the first panel surface 42 is oriented away or faces away from the consoles 20.

The first side panel 41 includes a frame 45 that surrounds and supports a vision panel 44. The frame 45 can be formed of any suitable material such as plastic or metal (e.g., aluminum), and the vision panel 44 can be formed of any suitable material such as plastic or glass. Preferably, the vision panel 44 is transparent or semi-transparent.

The movable panel 90 has a first panel surface 92 that is oriented in the first panel direction P1 and/or toward the bow 24 and an opposite second panel surface 93 that is oriented in the second panel direction P2 and/or toward the stem 25. Note that the movable panel 90 is angled relative to the consoles (e.g., the movable panel 90 and the top of the consoles 20 define an acute angle therebetween) such that the second panel surface 93 is oriented toward or faces the consoles 20 and the first panel surface 92 is oriented toward or faces away from the consoles 20.

The movable panel 90 includes a frame 95 that surrounds and supports a vision panel 94. The frame 95 can be formed of any suitable materials such as plastic or metal (e.g., aluminum), and the vision panel 94 can be formed of any suitable material such as plastic or glass. Preferably, the vision panel 44 is transparent or semi-transparent.

FIG. 4-7 depict the hinge assembly 60 in greater detail. The hinge assembly 60 includes a body 61 which is coupled to the frame 45 of the first side panel 41. The body 61 extends between a first body end 62 coupled to the frame 45 near the first end 31 of the windshield 30 and a second body end 32 coupled to the frame 45 near the second body end 32.

The hinge assembly 60 includes a first set of hinge components (generally identified by part number 55) located near the first body end 62 and a second set of hinge components (generally identified by part number 56) located near the second body end 63 which are similar to the first set of hinge components. It should be understood that while the first set of hinge components is described herein below, the second set of components can include any of the features and/or components described with respect to the first set of hinge components. Similar components between the first set of hinge components and the second set of hinge components may be depicted with the same part numbers in the Figures, however, it should be understood that the similarly marked components are not necessarily identical. For example, the first flange 64 located at the first body end 62 can have a different shape than the first flange 64 located at the second body end 63.

One or more fasteners 66 (e.g., screws, bolts) secure the body 61 to the frame 45 of the first side panel 41. One or more guide blocks 120 are coupled to the body 61 and generally extend laterally away from the body 61. One or more arm stops 130 are coupled to the body 61 and generally extend laterally away from the body 61.

A first flange 64 and a second flange 65 extend away (e.g., laterally) from the body 61. The first flange 64 is axially spaced apart from the second flange 65. In certain examples, the first flange 64 is axially spaced above the second flange 65. The first flange 64 extends parallel to the second flange 65 (e.g., the first flange 64 extends in a plane that is parallel to a separate plane in which the second flange 65 extends). The first flange 64 defines a pair of holes 67, and the second flange 65 defines a hole 68 that aligns with one of the pair of holes 67 in the first flange 64.

A bracket 80 is coupled to the frame 95 of the first movable panel 90 with fasteners 85 (e.g., screws, bolts). The bracket 80 is generally axially aligned with the flanges 64, 65. The bracket 80 includes a first bracket leg 81 and a second bracket leg 82 that generally extend parallel to each other. In certain examples, the bracket 80 is "J" shaped. In certain examples, a spacer block 124 is sandwiched between the frame 95 and the bracket 80. The first bracket leg 81 includes a pair of holes 83, and the second bracket leg 82 includes a hole 84 that aligns with one of the pair of holes 67 in the first bracket leg 81.

A support arm 70 has a first support arm end 71 coupled to the flange 64, 65 and a second support arm end 72 coupled to the bracket 80. Specifically, a fastener 73 (e.g., screw, bolt, pin) extends through the aligned holes 67, 68 in the flanges 64, 65 and the first support arm end 71 to thereby couple the first support arm end 71 to the flanges 64, 65 such that the support arm 70 is pivotable about a first pivot axis 101 which is longitudinally offset from the movable panel 90 in a direction toward the stern 25. Another fastener 73 extends through the aligned holes 83, 84 in the legs 81, 82 and the second support arm end 72 to thereby couple the second support arm end 72 to the legs 81, 82 such that the support arm 70 is also pivotable about a second pivot axis 102 which is also longitudinally offset from the movable panel 90 in a direction toward the stern 25. The shape of the support arm 70 can vary, and in certain examples, the support arm 70 is "L" shaped. As such, the movable panel 90 is pivotable about the first pivot axis 101 and the second pivot axis 102 into and between the first position and the second position.

A guide arm 86 has a first guide arm end 87 coupled to the second flange 65 and a second guide arm end 88 coupled to the bracket 80. Specifically, a fastener 73 extends through the hole 68 in the second flange 65 and the first guide arm end 87 to thereby couple the first guide arm end 87 to the flange 65 such that that the guide arm 86 is pivotable about a third pivot axis 103. Another fastener 73 extends through the hole 84 in the second leg 82 and the second guide arm end 88 to thereby couple the second guide arm end 88 to the second leg 82 such that the guide arm 86 is also pivotable about a fourth pivot axis 104. The third pivot axis 103 and the fourth pivot axis 104 are longitudinally offset from the movable panel 90 in a direction toward the stem 25. The shape of the guide arm 86 can vary, and in certain examples, the guide arm 86 is "L" shaped. The guide arm 86 is axially offset from the support arm 70. In certain examples, the flanges 64, 65, the support arm 70, the bracket 80, and the guide arm 86 act as a linkage. In certain examples, the guide arm 86 extends parallel to the support arm 70.

Figure 4:
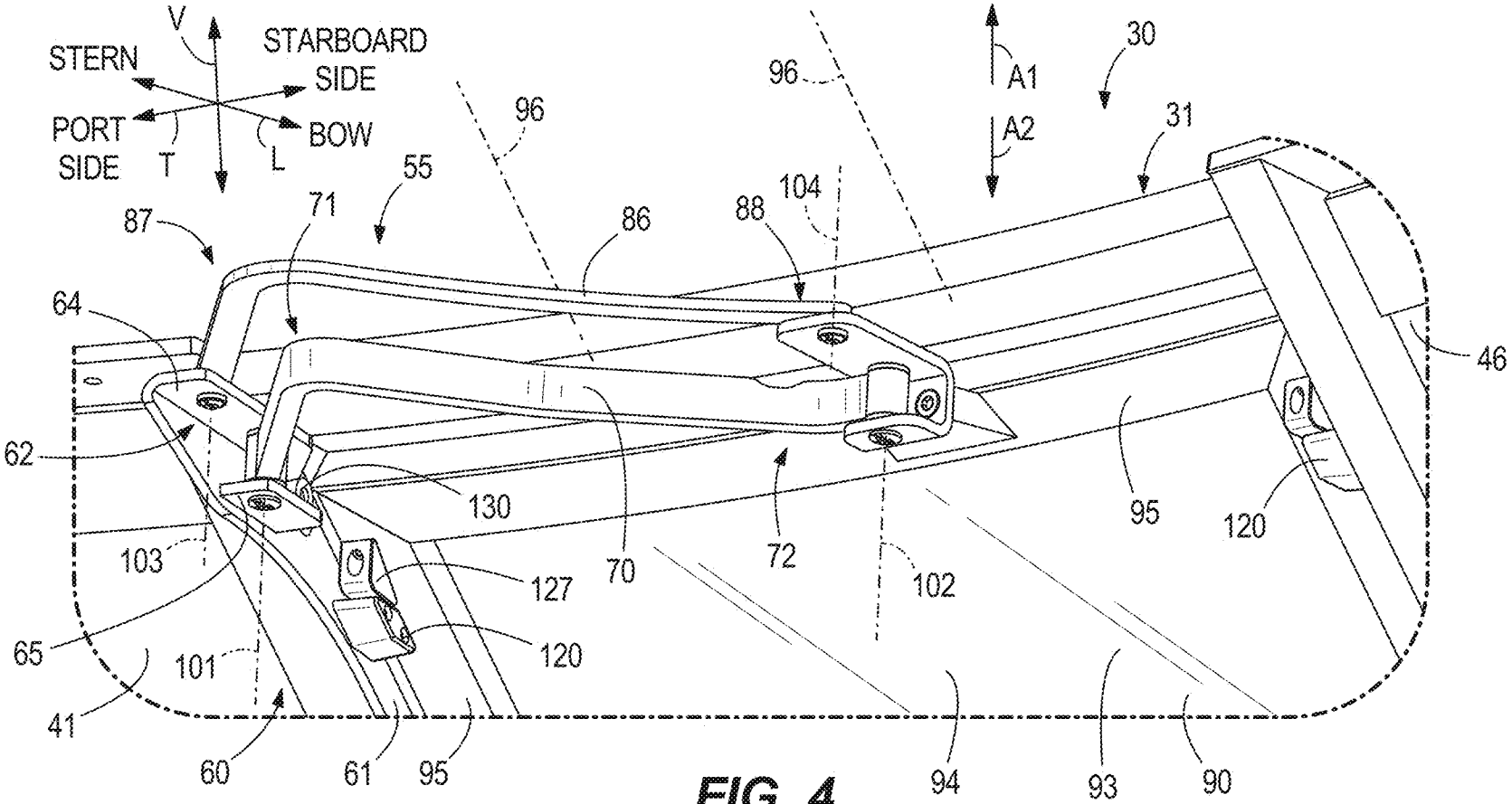
FIG. 4 is an enlarged perspective view of the windshield within line 4-4 on FIG. 3.
Figure 5:
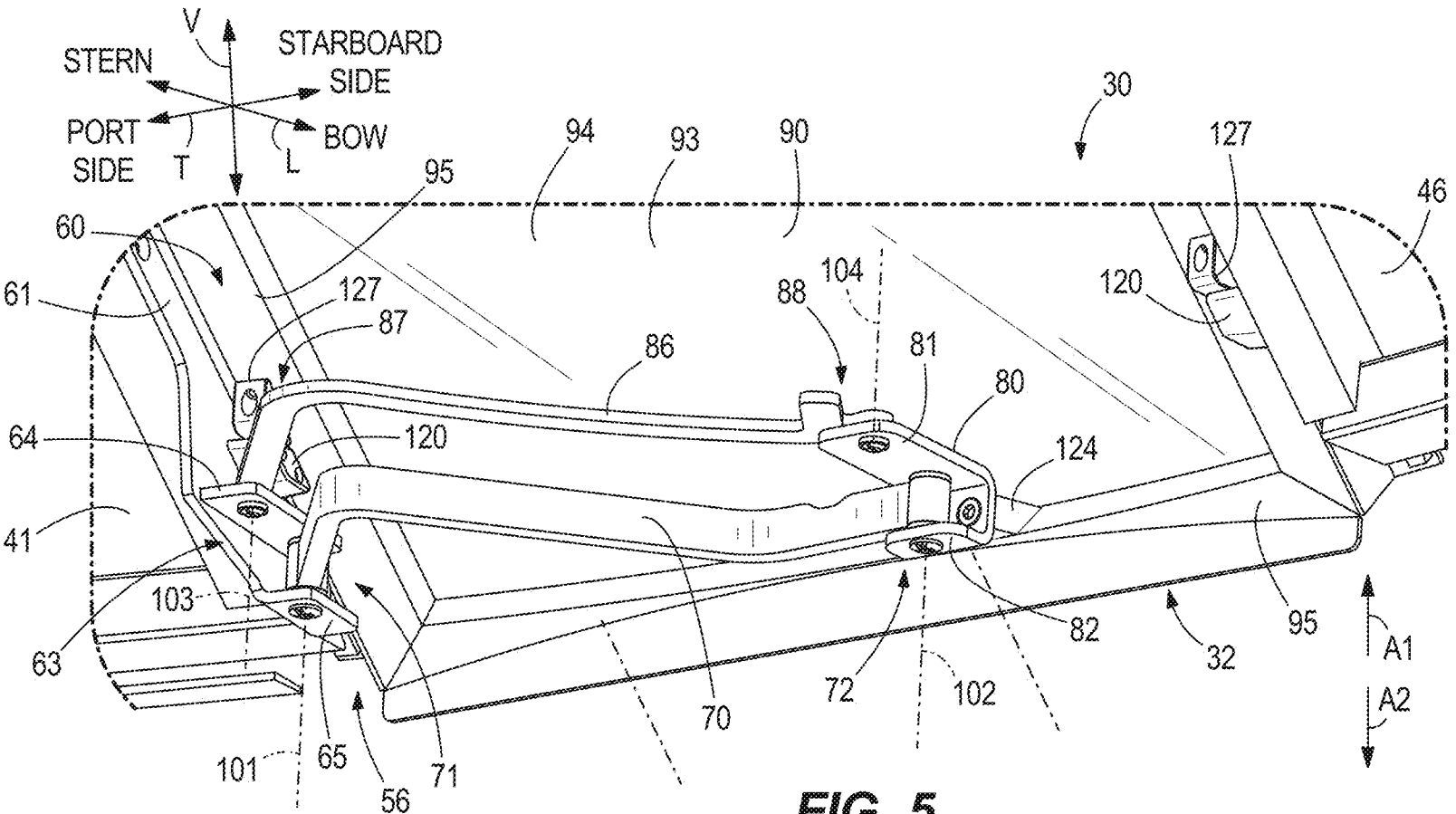
FIG. 5 is an enlarged perspective view of the windshield within line 5-5 on FIG. 3.
Figure 6:
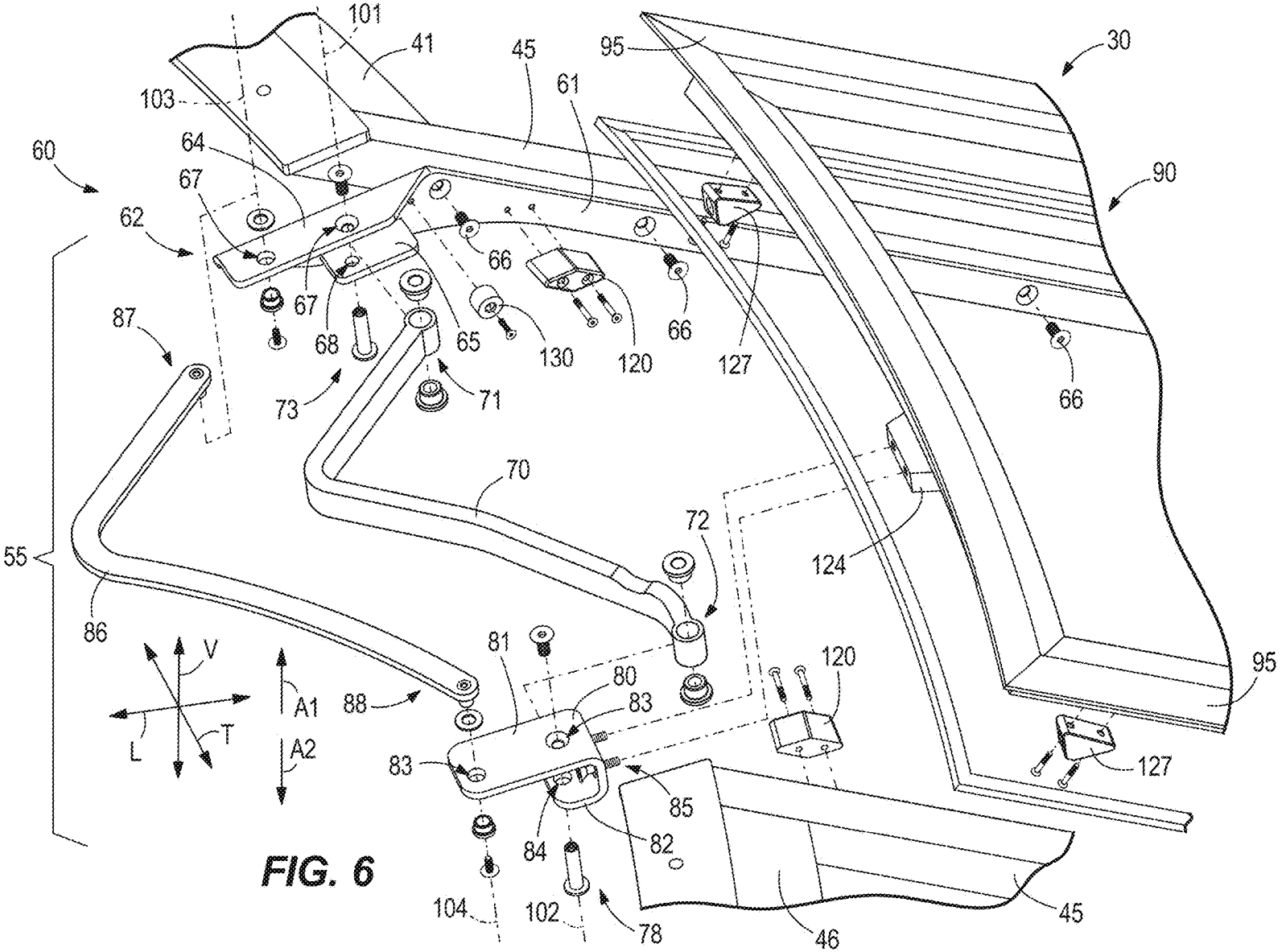
FIGS. 6-7 are exploded views of an example hinge assembly according to the present disclosure.
Figure 7:
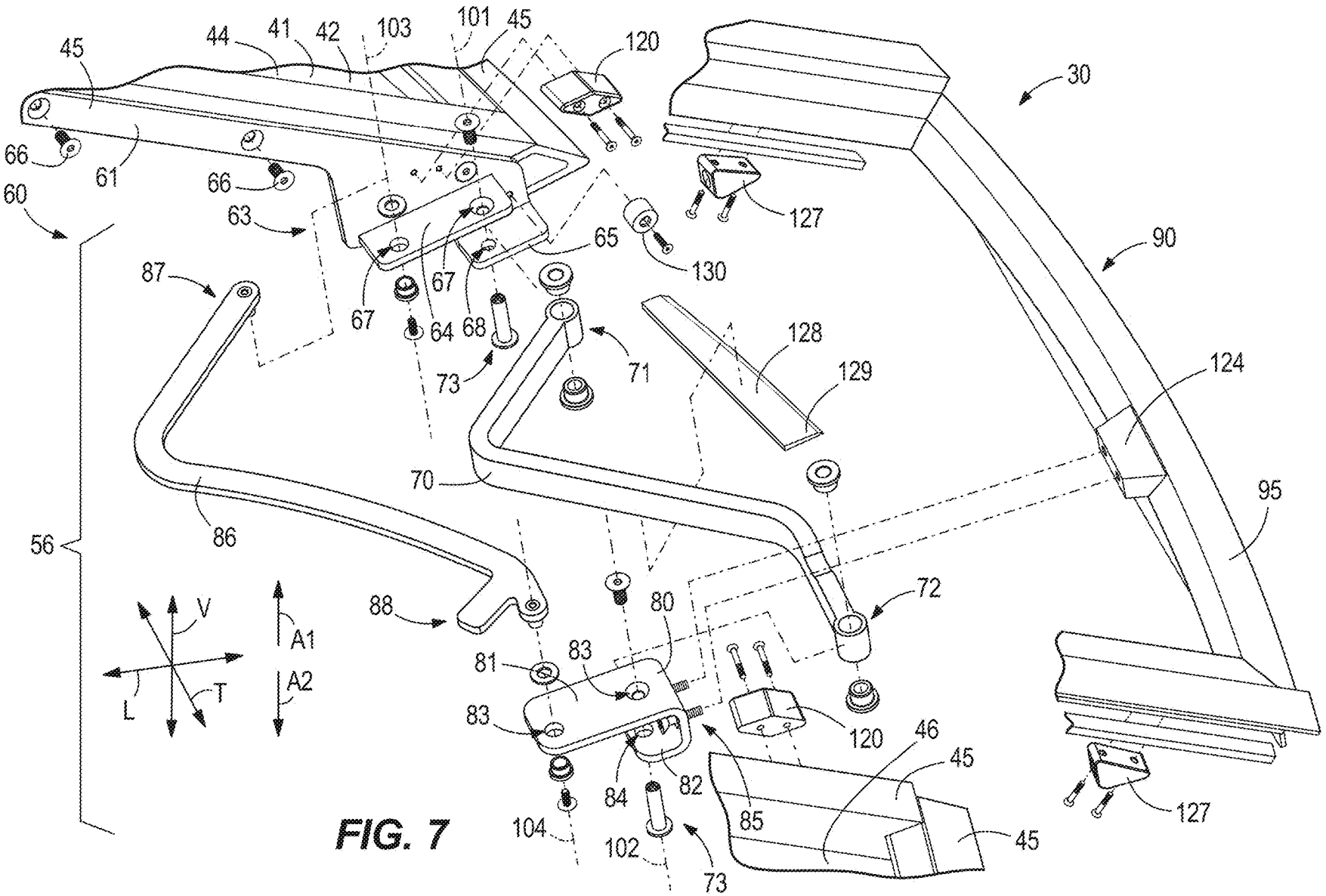

The pivot axes 101, 102, 103, 104 extend parallel to each other and are offset from each other. In certain examples, the pivot axes 101, 102, 103, 104 each axially extend parallel to the example axis V noted above. In certain examples, the pivot axes 101, 102, 103, 104 extend transverse to the movable panel 90. In certain examples, the pivot axes 101, 102, 103, 104 extend relative to the movable panel 90 such that an acute angle (e.g., 60.0 degrees, 90.0 degrees, 45.0 degrees) is defined between the movable panel 90 (e.g., the second panel surface 93 of the movable panel 90) and each pivot axis 101, 102, 103, 104. In certain examples, the pivot axes 101, 102, 103, 104 extend transverse to the movable panel 90 (note an example plane 96 in which the movable panel 90 is schematically depicted in FIGS. 4-5 in dash-dot lines)

Figure 8:
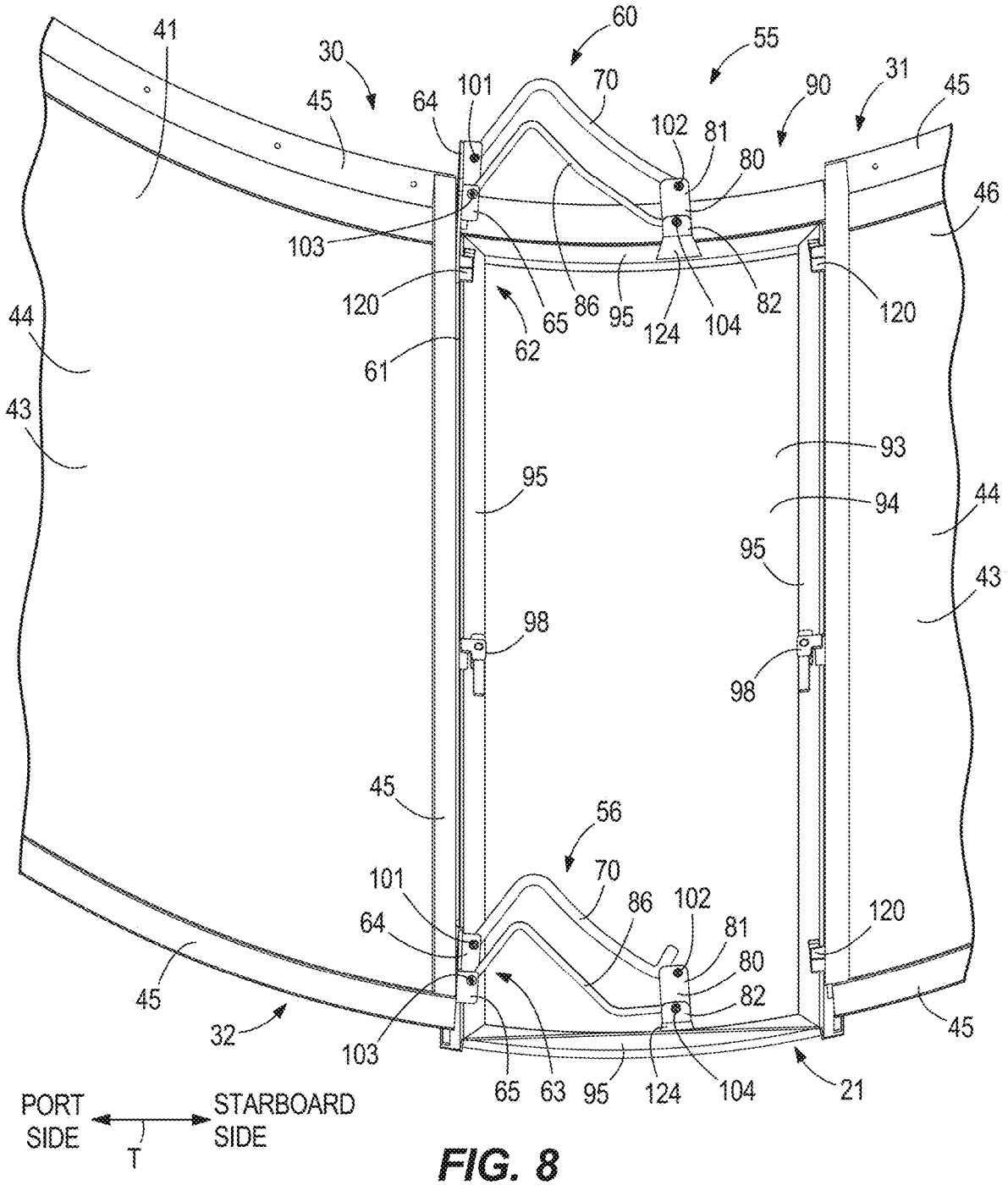
FIG. 8 is a schematic view of an example windshield according to the present disclosure with the movable panel in the first position.
Figure 9:
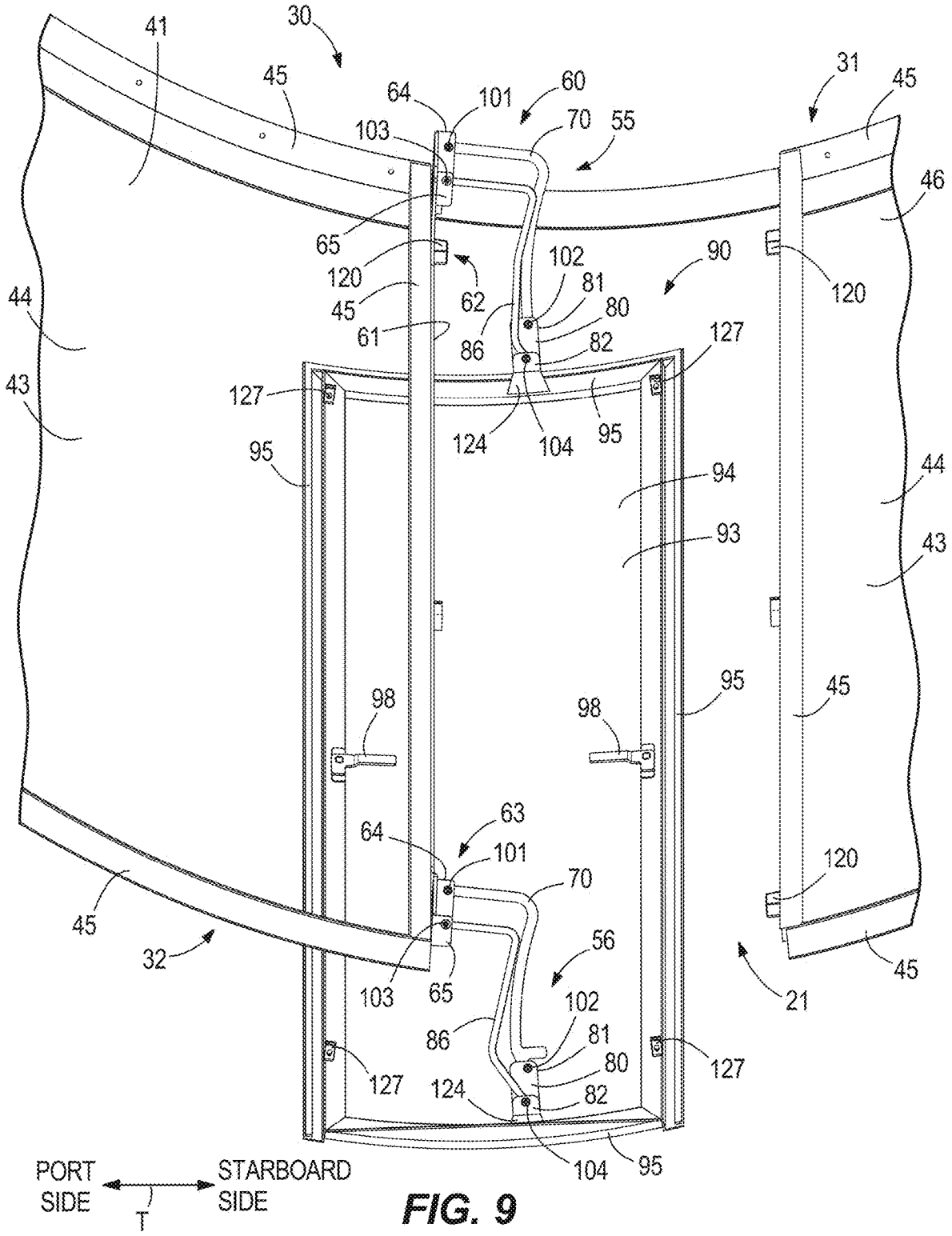
FIG. 9 is a schematic view like FIG. 8 with the movable panel in an intermediate position.
Figure 10:
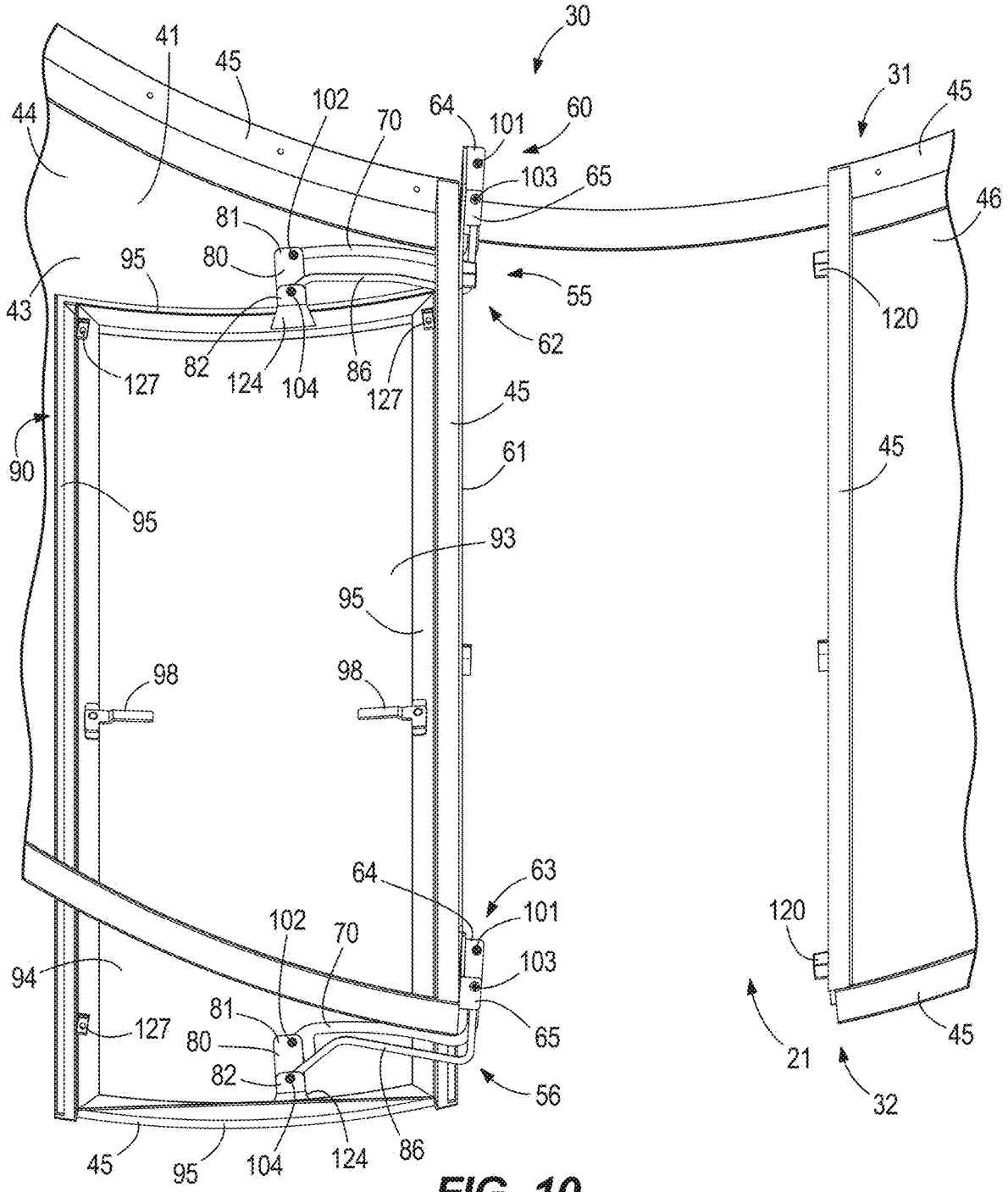
FIG. 10 is a schematic view like FIG. 8 with the movable panel in the second position.

Referring now to FIGS. 8-10, an example operational sequence for moving the movable panel 90 into and between the first position (FIG. 8) and the second position (FIG. 10) is described herein below. FIG. 9 depicts the movable panel 90 in an intermediate position between the first position and the second position. Note that FIGS. 8-10 depict the windshield from the vantage point positioned behind the windshield facing in a direction from the stern 25 to the bow 24 through the windshield 30.

In the first position, the movable panel 90 extends adjacent to the first side panel 41 and/or between the side panels 41, 46 thereby preventing wind and other environmental elements from passing through the pathway 21 (see also FIG. 1). In certain examples, in the first position, the movable panel 90 at least partially closes the pathway 21. A gasket or seal (not depicted) may be provided between the frame 95 of the movable panel 90 and the frames 45 for the side panels 41, 46 such that there is a fluid-tight seal is between the movable panel 90 and the side panels 41, 46. In certain examples, a gasket or other sealing member is positioned between the movable panel 90 and the hardtop 22 such that a fluid-tight seal is therebetween. One or more rest blocks 127 (FIG. 9) coupled to the frame 95 of the movable panel 90 engage with the guide blocks 120 to reduce or eliminate inadvertent axial movement or 'sagging' of the movable panel 90 in the second axial direction A2 and/or relative to the side panels 41, 46. Further, the rest blocks 127 advantageously support the movable panel 90 on the side panels 41, 46 thereby reducing warping of the movable panel, reducing binding of the hinge assembly 60, and/or keeping the hinge assembly 60 square. One or more latches 98 coupled to frame 95 are in a latched position to thereby prevent inadvertent movement of the movable panel 90 toward the bow 24 of the marine vessel 10 and/or toward the second position (FIG. 10).

To move the movable panel 90 toward the second position (FIG. 10), the operator moves the latches 98 to unlatched positions (see FIGS. 9-10) and applies an opening force (e.g., pulling or pushing force; see arrow F1 on FIG. 2 which represents the movement path of the movable panel 90 from the first position to the second position see arrow) in a first direction toward the bow 24 and/or axially upward in a first axial direction A1. As the opening force is applied, the rest blocks 127 slide along the guide blocks 120 and the movable panel 90 disengages from the side panels 41, 46. In certain examples, as the rest blocks 127 slide along the guide blocks 120 and/or once the rest blocks 127 no longer engage the guide blocks 120, the movable panel 90 may axially move in a second axial direction A2 due to force of gravity along and/or adjacent to the guide blocks 120. The support arms 70, the guide arms 86, and the movable panel pivot about the axes 101, 102, 103, 104.

Further application of the opening force moves the movable panel 90 through the intermediate position (FIG. 9) and into the second position (FIG. 10). As the movable panel 90 is moved into and between the first position and the second position, the support arms 70 and/or the guide arms 86 are configured to support the weight of the movable panel 90 and/or prevent binding of the hinge assembly 60. The support arms 70 and/or the guide arms 86 also guide the movable panel 90 such that the movable panel 90 does not strike the hardtop 22. Instead, the movable panel 90 moves in a path that is axially below the hardtop 22.

In the second position, the movable panel 90 overlaps the first side panel 41 and/or is in a stacked configuration with the first side panel 41 thereby permitting passage through the pathway 21. In certain examples, in the second position, the movable panel 90 at least partially opens the pathway 21.

Note that as the movable panel 90 is moved into and between the first position and the second position the first panel surface 92 remains oriented in the first panel direction P1, toward the bow 24, and/or away from the first side panel 41 (see also FIGS. 1 and 2). Specifically, in the second position (FIGS. 1 and 8), the first panel surface 92 is oriented in the first panel direction P1, toward the bow 24, and/or away from the first side panel 41. In the first position (FIGS. 2 and 10) the first panel surface 92 is oriented in a first panel direction P1, toward the bow 24, and/or away from the first side panel 41.

Figure 11:
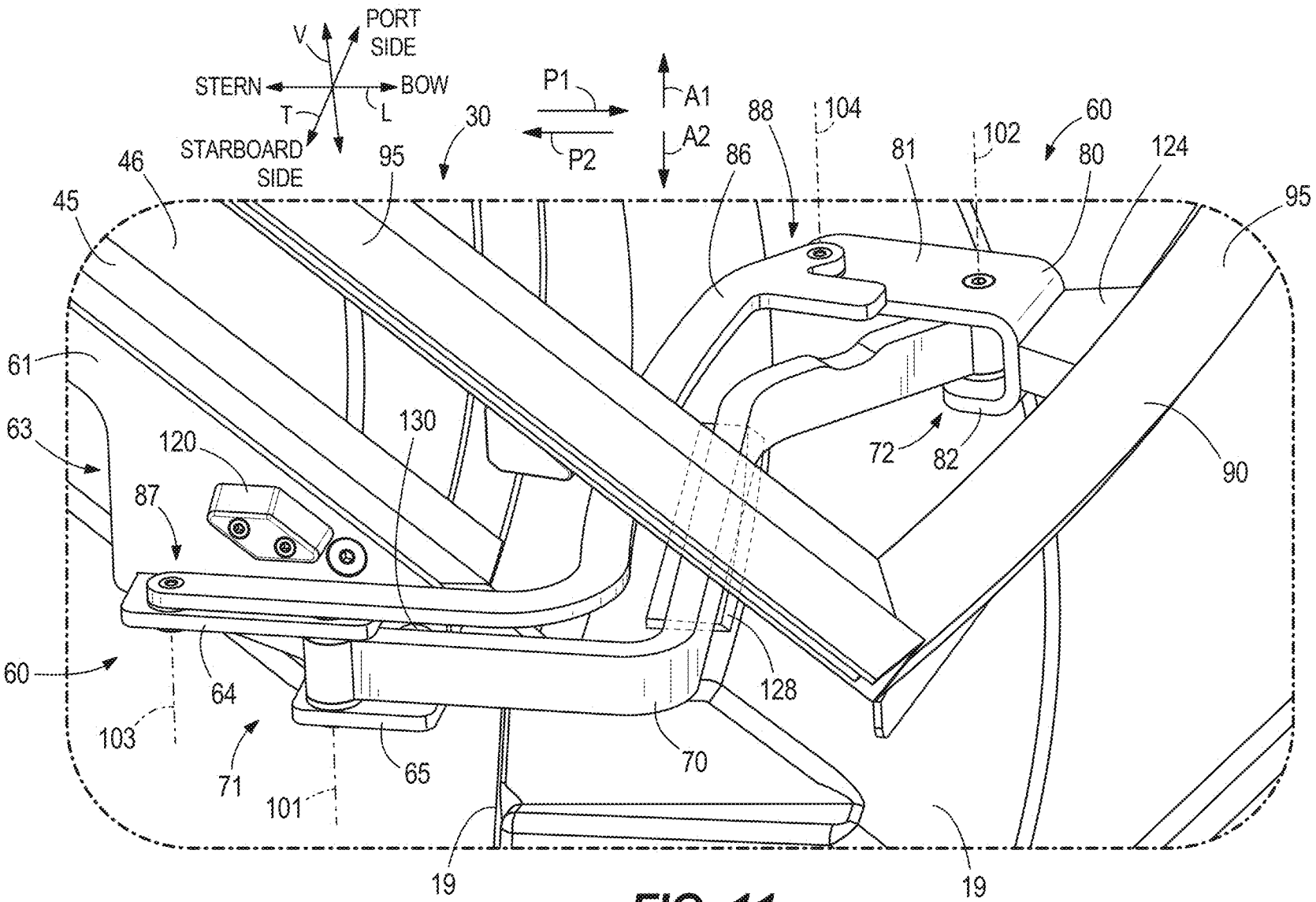
FIG. 11 is an enlarged view within line 11-11 on FIG. 2.

In the second position, the pathway 21 is open such that occupants may pass through the pathway 21 and past the windshield 30 to the bow 24 or the stem 25. The frame 95 of the movable panel 90 also rests on a rest pad 128 (FIGS. 7 and 11) coupled to the console 20 that is configured to axially support the movable panel 90 in the second position. The rest pad 128 advantageously is also configured to reduce warping of the movable panel 90, reduce sagging of the movable panel 90 while in the second position, and/or keep the hinge assembly 60 square to thereby prevent binding of the hinge assembly 60 when the movable panel 90 is moved again. In certain examples, the rest pad 128 is generally wedge-shaped and/or has a sloped surface that is configured to axially upwardly cam the movable panel 90 in the first axial direction A1 as the movable panel 90 is moved in a direction from the first position to the second position. The first axial direction A1 is opposite the second axial direction A2. Note that the axial directions A1, A2 may extend parallel with the example axis V noted above.

The support arms 70 engage the arm stops 130 which prevents further movement of the movable panel 90 past the second position (FIG. 10). In certain examples, the arm stop 130 engages the support arm 70 between the first support arm end 71 and the second support arm end 72. A latching mechanism (not depicted) may latch the movable panel 90 in the open position and/or prevent inadvertent movement of the movable panel 90 into the closed position. The shape of the support arm 70 and the guide arm 86 as such that the arms 70, 86 do not contact the first side panel 41.

To move the movable panel 90 toward the first position (FIG. 8), the operator applies a closing force (e.g., pulling or pushing force; see arrow F2 on FIG. 2 which represents the movement path of the movable panel 90 from the second position to the first position) in a second direction toward the stern 25. As the closing force is applied, the frame 95 of the movable panel 90 slides along and off the rest pad 128. The support arms 70, the guide arms 86, and the movable panel 90 pivot about the axes 101, 102, 103, 104. Further application of the closing force moves the movable panel 90 through the intermediate position (FIG. 9) and into the first position (FIG. 8). As the movable panel 90 is moved into the first position (FIG. 8), the rest blocks 127 slide along the hinge guide blocks 120. In certain examples, the guide blocks 120 axially upwardly cam the movable panel 90 in the first axial direction A1. The operator then moves the latches 98 to the latched positions (see FIG. 8) to lock the movable panel 90 in the first position (FIG. 8) and prevent inadvertent movement of the movable panel 90 toward the second position (FIG. 10).

In certain independent examples, a marine vessel includes a bow and a stem, a deck, a console located on the deck between the bow and the stem, and a windshield on the console. The windshield includes a side panel and a movable panel coupled to the side panel. The movable panel includes a first panel surface and the movable panel is pivotable about a first pivot axis and a second pivot axis into and between a first position in which the movable panel extends adjacent to the side panel and the first panel surface is oriented toward the bow and a second position in which the movable panel overlaps the side panel and the first panel surface is oriented toward the bow.

Optionally, the deck defines a pathway thereon, and in the first position, the movable panel closes the pathway and in the second position the pathway is open. Optionally, the first pivot axis and the second pivot axis are parallel to each other. Optionally, the first pivot axis and the second pivot axis extend transverse to the movable panel. Optionally, a first support arm and a second support arm spaced apart from the first support arm couple the movable panel to the side panel and a first guide arm and a second guide arm spaced apart from the second guide arm couple the movable panel to the side panel. Optionally, a rest pad is coupled to the console and configured to axially cam the movable panel in a first axial direction as the movable panel is moved into the second position. Optionally, a guide block is coupled to the side panel and a rest block coupled to the movable panel such that when the movable panel is moved into the first position, the rest block engages the guide block such that the guide block cams the movable panel in a first axial direction.

In certain independent examples, a marine vessel includes a bow and a stem, a deck, a pair of consoles located on the deck between the bow and the stem, and a windshield on the consoles. The windshield includes a first side panel, a second side panel, and a movable panel coupled to the first side panel. The movable panel includes a first panel surface and is pivotable about a first pivot axis and a second pivot axis into and between a first position in which the movable panel extends between the first side panel and the second side panel and the first panel surface is oriented toward the bow and a second position in which the movable panel overlaps the first side panel and the first panel surface is oriented toward the bow.

Optionally, a pathway extends between the consoles and in the first position the movable panel closes the pathway and in the second position the pathway is open. Optionally, the first pivot axis and the second pivot axis are parallel to each other. Optionally, the first pivot axis and the second pivot axis extend transverse to the movable panel. Optionally, a rest pad coupled is to one console of the pair of consoles and configured to axially cam the movable panel in a first axial direction as the movable panel is moved into the second position. Optionally, a guide block is coupled to the first side panel and a rest block coupled to the movable panel, and when the movable panel is moved toward the first position, the rest block engages the guide block such that the guide block cams the rest block and the movable panel in a first axial direction.

In certain independent examples, a marine vessel includes a bow and a stem, a deck, a console on the deck between the bow and the stern, and a windshield on the console. The windshield includes a side panel and a movable panel pivotably coupled to the side panel such that the movable panel is pivotable about a first pivot axis and a second pivot axis into and between a first position in which the movable panel extends adjacent the side panel and a second position in which the movable panel overlaps the side panel.

Optionally, the first pivot axis and the second pivot axis are spaced apart from and parallel to each other. Optionally, the bow is longitudinally spaced apart from the stern and the first pivot axis and the second pivot axis are longitudinally offset from the movable panel in a direction toward the stem. Optionally, the deck defines a pathway thereon, and in the first position, the movable panel closes the pathway and in the second position the pathway is open. Optionally, a hinge assembly couples the side panel to the movable panel, and the hinge assembly includes a support arm with a first support arm end through which the first pivot axis extends and a second support arm end through which the second pivot axis extends and a guide arm with a first guide arm end through which a third pivot axis extends and a second guide arm end through which a fourth pivot axis extends. The movable panel is further pivotable of the third pivot axis and the fourth pivot axis into and between the first position and the second position. Optionally, the hinge assembly includes a flange coupled to the side panel and a bracket coupled to the movable panel. The first support arm end and the first guide arm end are coupled to the flange and the second support arm end and the second guide arm end are coupled to the bracket. Optionally, the first pivot axis, the second pivot axis, the third pivot axis, and the fourth pivot axis are parallel to each other and extend transverse to the movable panel.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives, and modifications are possible within the scope of the appended claims.

This written description uses examples to disclose the invention and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A marine vessel comprising:

a bow and a stem;

a deck;

a console located on the deck between the bow and the stern;

a windshield on the console, the windshield including a side panel and a movable panel coupled to the side panel, wherein the movable panel includes a first panel surface and is pivotable about a first pivot axis and a second pivot axis into and between:

a first position in which the movable panel extends adjacent to the side panel and the first panel surface is oriented toward the bow; and a second position in which the movable panel overlaps the side panel and the first panel surface is oriented toward the bow.

2. The marine vessel according to claim 1, wherein the deck defines a pathway thereon, and wherein in the first position, the movable panel closes the pathway and in the second position the pathway is open.

3. The marine vessel according to claim 1, wherein the first pivot axis and the second pivot axis are parallel to each other.

4. The marine vessel according to claim 3, wherein the first pivot axis and the second pivot axis extend transverse to the movable panel.

5. The marine vessel according to claim 4, further comprising:

a first support arm and a second support arm spaced apart from the first support arm that couple the movable panel to the side panel; and a first guide arm and a second guide arm spaced apart from the first guide arm that couple the movable panel to the side panel.

6. The marine vessel according to claim 1, further comprising a rest pad coupled to the console and configured to axially cam the movable panel in a first axial direction as the movable panel is moved into the second position.

7. The marine vessel according to claim 1, further comprising a guide block coupled to the side panel and a rest block coupled to the movable panel, wherein when the movable panel is moved into the first position, the rest block engages the guide block such that the guide block cams the movable panel in a first axial direction.

8. A marine vessel comprising:

a bow and a stem;

a deck;

a pair of consoles located on the deck between the bow and the stern;

a windshield on the consoles and including a first side panel, a second side panel, and a movable panel coupled to the first side panel, wherein the movable panel includes a first panel surface and is pivotable about a first pivot axis and a second pivot axis into and between:

a first position in which the movable panel extends between the first side panel and the second side panel and the first panel surface is oriented toward the bow; and a second position in which the movable panel overlaps the first side panel and the first panel surface is oriented toward the bow.

9. The marine vessel according to claim 8, wherein a pathway extends between the consoles and wherein in the first position the movable panel closes the pathway and in the second position the pathway is open.

10. The marine vessel according to claim 8, wherein the first pivot axis and the second pivot axis are parallel to each other.

11. The marine vessel according to claim 8, wherein the first pivot axis and the second pivot axis extend transverse to the movable panel.

12. The marine vessel according to claim 8, further comprising a rest pad coupled to one console of the pair of consoles and configured to axially cam the movable panel in a first axial direction as the movable panel is moved into the second position.

13. The marine vessel according to claim 8, further comprising a guide block coupled to the first side panel and a rest block coupled to the movable panel, wherein when the movable panel is moved toward the first position, the rest block engages the guide block such that the guide block cams the rest block and the movable panel in a first axial direction.

14. A marine vessel comprising:

a bow and a stem;

a deck;

a console on the deck between the bow and the stem; and a windshield on the console, the windshield including a side panel and a movable panel pivotably coupled to the side panel such that the movable panel is pivotable about a first pivot axis and a second pivot axis into and between a first position in which the movable panel extends adjacent the side panel and a second position in which the movable panel overlaps the side panel.

15. The marine vessel according to claim 14, wherein the first pivot axis and the second pivot axis are spaced apart from and parallel to each other.

16. The marine vessel according to claim 14, wherein the bow is longitudinally spaced apart from the stern and the first pivot axis and the second pivot axis are longitudinally offset from the movable panel in a direction toward the stem.

17. The marine vessel according to claim 14, wherein the deck defines a pathway thereon, and wherein in the first position, the movable panel closes the pathway and in the second position the pathway is open.

18. The marine vessel according to claim 14, further comprising a hinge assembly that couples the side panel to the movable panel, the hinge assembly includes:

a support arm with a first support arm end through which the first pivot axis extends and a second support arm end through which the second pivot axis extends; and a guide arm with a first guide arm end through which a third pivot axis extends and a second guide arm end through which a fourth pivot axis extends;

wherein the movable panel is further pivotable about the third pivot axis and the fourth pivot axis into and between the first position and the second position.

19. The marine vessel according to claim 18, wherein the hinge assembly includes a flange coupled to the side panel and a bracket coupled to the movable panel;

wherein the first support arm end and the first guide arm end are coupled to the flange; and wherein the second support arm end and the second guide arm end are coupled to the bracket.

20. The marine vessel according to claim 18, wherein the first pivot axis, the second pivot axis, the third pivot axis, and the fourth pivot axis are parallel to each other and extend transverse to the movable panel.

* * * * *